United States Patent [19]

Horak

[11] 3,955,738

[45] May 11, 1976

[54] VARIABLE INCREMENT FORM FEED MECHANISM

[75] Inventor: Anthony Horak, Detroit, Mich.

[73] Assignee: Burroughs Corporation, Detroit, Mich.

[22] Filed: Nov. 20, 1974

[21] Appl. No.: 525,496

[52] U.S. Cl. ..... 226/140; 226/153

[51] Int. Cl.[2] ..... B65H 17/26

[58] Field of Search ..... 226/153, 139, 140; 83/260; 74/825, 826, 840, 392, 413, 414

[56] References Cited

UNITED STATES PATENTS

| | | | |
|---|---|---|---|
| 1,637,658 | 8/1927 | Rose | 226/140 X |
| 2,150,824 | 3/1939 | Fischer | 226/140 |
| 2,170,830 | 8/1939 | Minkow | 226/140 |

*Primary Examiner*—Allen N. Knowles

*Attorney, Agent, or Firm*—Ronald L. Taylor; Edwin W. Uren; Paul W. Fish

[57] ABSTRACT

A mechanism for incrementally advancing continuous paper forms comprising a pair of opposing cams which drive said forms therebetween, each said cam having a plurality of camming surfaces whose phase relative to the other said cam may be manually varied. For each rotation of said pair of cams, said forms are incremented a number of times equal to the total number of camming surfaces per one said cam where an increment is phase dependent.

9 Claims, 3 Drawing Figures

0
.705"
1.57"
2.36"
3.14"
45°
45°

VARIABLE INCREMENT FORM FEED MECHANISM

BACKGROUND OF THE INVENTION

The present invention relates to an apparatus for feeding continuous forms in adjustable increments, and particularly to the use of opposibly disposed camming surfaces to feed forms therebetween.

PRIOR ART

It has long been known in the art that by using a pair of oppositively disposed eccentric camming surfaces whose phase is variable as between them, that a form could be incremented in varying amounts dependent on said phasing as set between said camming surfaces.

The most serious drawback to such devices has been that only one increment has been possible per rotation of said pair of camming surfaces. As a result, with devices such as line printers becoming much faster, the camming surfaces for driving forms must rotate even more quickly to compress a greater number of increments within a constant time frame.

This increased cam rotation results in many high-speed related problems among which is the accelerated friction wear on the unitary camming surface on each cam. Furthermore, a more powerful and expensive drive unit must be used to rotate the camming surface fast enough to generate the necessary form speed. Yet another problem is that the phasing between cams becomes more critical if precise incrementing is to be maintained for printing purposes. A final problem is that the increased use of the camming surfaces lowers the adhesion-friction coefficient of the form to the cam surfaces thus necessitating closer physical contact of the cams to the form to raise said coefficient, but this of course exacerbates the first problem mentioned supra.

SUMMARY OF THE INVENTION

It is accordingly an important object of the invention to provide an improved mechanism for continuous feeding of forms at high speed at variable increment settings.

It is another object of the invention to provide a pair of oppositively disposed cams that by their collective rotation move forms along by camming said forms therebetween.

It is a further object of the invention to provide each of the cams with a plurality of equal arced camming surfaces.

It is yet another object of this invention to be able to simultaneously and identically adjust the phase of all camming surfaces on one said cam relative to all other camming surfaces of the other said cam by one adjustment so as to be able to proportionally limit the travel of said forms per each increment of said cams.

An additional object of the invention is to provide a clutching mechanism for allowing adjustment of one cam's plurality of surfaces relative to the other.

In carrying out the objects of the invention, a pair of oppositively disposed camming rollers each having a plurality of discrete camming surfaces identical as to themselves and as to the other roller thus enabling the pair of said rollers per one collective rotation to increment a form as many times as there are surfaces on one roller with each increment being proportional to the phase between each camming surface's arc and its opposer.

The invention being further characterized by a pair of gears disposed on the shafts carrying the camming rollers, said gears being operatively coupled to each other but may be clutched and rotated as to each other thereby varying the gears and also said camming surfaces relative phase.

BRIEF DESCRIPTION OF THE DRAWINGS

Various other objects, advantages and meritorious features of the invention will become more fully apparent from the following specification, appended claims and accompanying drawing sheets.

The features of a specific embodiment of the invention are illustrated in the drawings in which.

DESCRIPTION OF A PREFERRED EMBODIMENT OF THE INVENTION

Figures 1, 2, 3:
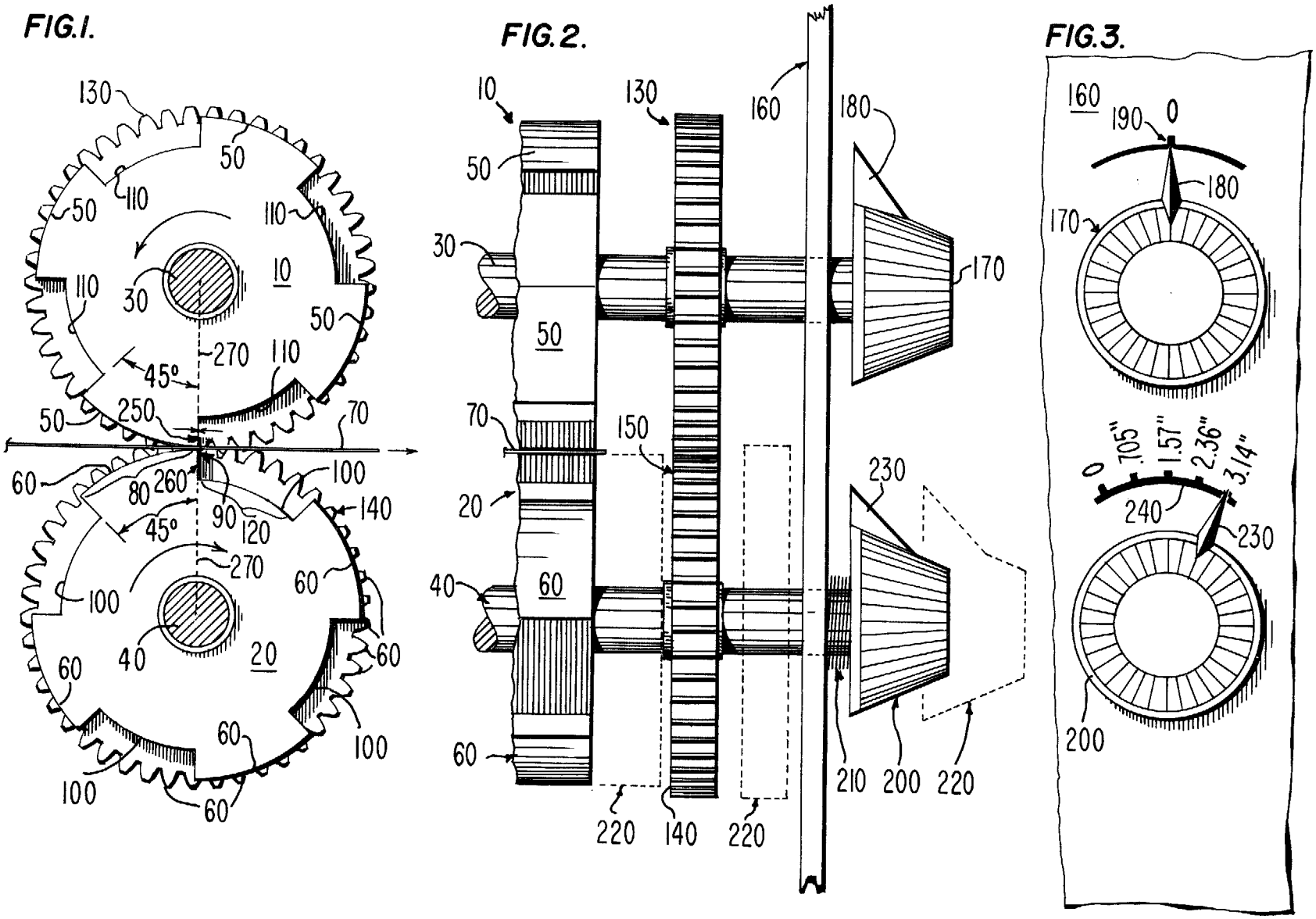
FIG. 1 is a side view of the camming surfaces.
FIG. 2 is a frontal view of the camming surfaces of FIG. 1.
FIG. 3 is a frontal view of the adjustment mechanism for the camming surfaces of FIG. 1 and FIG. 2.

Referring to FIGS. 1 through 3 inclusive by the characters of reference, there is illustrated an apparatus in accordance with the invention for incrementally camming forms in an adjustable manner.

The components used in the invention include a pair of camming rollers 10, 20 as shown in FIGS. 1 and 2 each suspended on its own drive shaft 30, 40. The camming rollers 10, 20 are disposed towards each other so that their camming surfaces 50, 60 will frictionally grip a continuous form 70 being fed through by said rollers 10, 20 pressing against each other. There are four camming surfaces 50, 60 per roller 10, 20 in the preferred embodiment giving a maximum arc increment 80 of 45° with no phase difference 90 as will be explained infra. Alternatively, any number of camming surfaces 50, 60 greater than any one may be used to take advantage of said invention's features.

Each camming surface's 50, 60 circumferential distance 80 in the preferred embodiment is equal in arc to all other roller camming surfaces 50, 60 and each roller 10, 20 is identical to the other as to arc 80. The non-camming surface's 100, 110 arc distances 120 for both rollers 10, 20 in the preferred embodiment are equal as to themselves and also to the camming surface's arc distances 80.

It is further anticipated that in another embodiment (not shown) that a pair of camming rollers such as 10 and 20 could be used with one roller having a plurality of camming surfaces identical to the first roller 10 and the other roller would be a circular cam in place of the second roller 20. The net effect of this would be to have all the advantages mentioned supra except the ability to adjust and set the pitch 90 for a given increment since there is only one roller with a plural camming surface.

Connected axially to each of the rollers 10, 20 through its respective shaft 30, 40 is a toothed gear 130, 140 as shown in FIG. 2. These first 130 and second gears 140 are in turn operatively meshed together at point 150 thereby serving to precisely track the rollers 10, 20 as to each other and additionally serving as the medium by which phase 90 alternations may be made. The shaft 30 supporting the first gear 130 and roller 10 extends through a face plate 160 and has a first knob 170 secured to the end thereof which when rotated, will in turn displace the first gear 130 and roller 10. Specific application of this first knob 170 is to bring the first gear 130 and roller 10 to a home position when the knob's pointer 180 is directed at the home position setting 190 of the vernier marking on the face plate 160 as shown in FIG. 3.

The second gear 140 and roller 20 have the ability to be clutched away from the first gear 130 and roller 10 by a spring loaded second knob 200 secured to the end of the shaft 40 axially suspending the second gear 140 and roller 20. An end anchored spring 210 used for loading is operatively disposed between the second knob 200 and the face plate 160 and is tensionally extended when the second knob 200 and associated gear 140 and roller 20 are pulled away from the face plate 160 for clutching purposes as shown in dotted outline 220 in FIG. 2. Thus when the second knob 200 is pulled out thereby clutching the second gear 140 and roller 20, the second knob 200 may then be rotated so that its pointer 230 is directed to one of the settings 240 on the associated face plate vernier. Once this setting is made, the second knob 200 may be released and the tensioned spring 210 will pull the set second gear 140 and roller 20 back into meshed relation with the first gear 130 and roller 10. With these adjustments made, incrementing of the form 70 may commence in accordance with the settings.

The relationships that control the camming device described above are first of all dependent on how phasing 90 or as it is sometimes call, pitch, is defined. It is here defined to mean the angular difference of the leading edges 250, 260 of opposing camming surfaces 50, 60 as they each in turn contact the form 70. In the example shown in FIG. 1 there is no phase difference 90 since the leading edge 260 of the second roller 20 is aligned with edge 250 of the first roller 10 and therefore maximum incrementing or camming is possible since the camming surfaces 50, 60 meet for a full 45° per increment. The exact maximum increment possible can be determined as a function of the radius 270 and the number of camming surfaces 50, 60 per roller 10, 20 as expressed in the formula:

$$\text{Maximum Form Travel Per Increment} = \frac{\pi \times \text{Radius}}{\text{No. camming surfaces}}$$

Thus in the example with a radius 270 of 4 inches and four camming surfaces 50, 60, the maximum increment is 3.1416 inches or $\pi$. Expressed alternatively and independently of radius 270, there may be a maximum of 45° of camming as mentioned supra per increment according to the formula:

$$\text{Maximum camming angle} = \frac{180°}{\text{No. of camming surfaces}}$$

Any setting less than the maximum increment is a linear proportional subdivision thereof and indicates that there is a phase difference 90. For one complete revolution of the rollers, 10, 20, as many increments will be made as there are camming surfaces 50, 60 and the net incremental distance per revolution will of course depend on the second knob's 200 setting. In our case, there are four increments per revolution which with a maximum setting of 3.14 inches will give a net increment of 12.57 inches of form 70 travel per revolution in four equal increments. Conceivably then a line printer (not shown) could print four lines across 12.57 inches of form 70 per single revolution of the rollers 10, 20.

The features of the invention for this form feeding device accordingly are a pair of opposing rollers 10, 20 each having a plurality of camming surfaces 50, 60 which can be rotated much slower than a unitary camming surface roller by increasing the number of discrete said camming surfaces 50, 60 per roller 10, 20. By doing this, roller speed may be decreased even as incrementing speed is increased thus allowing less wear and tear on the rollers 10, 20 themselves and on the forms 70 being fed through. Additionally by slowing said rotation and increasing the number of camming surfaces 50, 60, more precise incrementing may be obtained even as the number of increments are increased per constant time frame.

Various changes may be made in the details of construction without departing from the spirit or scope of the invention as defined by the appended claims.

What is claimed is:

1. In a device for variably advancing forms and web media comprising means including a first and second plurality of camming surfaces disposed on and fixed to a pair of parallel and rotatable shafts and effective for incrementally advancing a said form or web medium relative to and between said pair of shafts, a first gear axially disposed on and fixed to an improved first of said pair of shafts, a second gear axially disposed on and fixed to an improved second of said pair of shafts and operatively meshed with said first gear for consistent tracking therewith and whereby the phase relationship between said first and said second pluralities of camming surfaces is maintained during the rotation of said pair of shafts, and improved means for selectively altering the phase relationship as between said first and said second pluralities of camming surfaces such that the incremental advance of said forms and web media thereby may be varied according to a selected distance per each increment of advancement, said improved first and second shaft comprising:

said first shaft being rotatably mounted and said second shaft being rotatably and translatably mounted.

2. The variable form advancing device defined in claim 1 wherein said improved phase relationship altering means comprises:

a. a first switch operatively coupled to said first shaft and effective for rotating said first gear and said first shaft for a defined home position, b. a second switch operatively coupled to said translatably mounted second shaft and effective for rotating said second gear and said second shaft, and c. a clutch operatively associated with said second switch and with said second shaft and by means of which said second gear and said second plurality of camming surfaces may be translatably disengaged from said first gear and from said first plurality of camming surfaces, said second switch thereupon being rendered operative to rotate said second shaft and said second plurality of camming surfaces independently of said first shaft and said first plurality of camming surfaces, said clutch following said independent rotation of said second shaft and said second plurality of camming surfaces being effective for re-engaging said second plurality of camming surfaces with said first plurality of camming surfaces and said second gear with said first gear to thereby selectively alter the phase relationship therebetween.

3. The variable form advancing device defined in claim 2 wherein said clutch is a tensionally loaded spring disposed between said second switch and said second gear and cooperating with said second switch and means for establishing said rotatable and translatable mounting of said second shaft.

4. The variable form advancing device defined in claim 2 wherein said first and said second switches are knobs fixed to the outboard ends of said first and said second shafts.

5. A mechanism for variably feeding continuous forms comprising:

a. a first roller disposed on a first rotatably mounted shaft and presenting a configuration of equally spaced apart and equally arced camming surfaces, b. a second roller of like configuration to said first roller disposed on a second rotatably and translatably mounted shaft for controlled frictional coupling with said first roller, c. a first gear axially disposed on and fixed to said first shaft, d. a second gear axially disposed on and fixed to said second shaft for selectable intermeshing coupling with said first gear, e. a first switch connected to said first shaft and effective for rotating said first gear and said first roller to a defined home position, f. a second switch connected to said second shaft and effective for translatably and rotatably activating said second shaft, the translation of said second shaft in a first direction serving to de-couple said second gear from said first gear and said second roller from said first roller, and the selectable rotation of said second switch and said second shaft with said gears and said rollers de-coupled serving to establish selectable phase relationships as between the camming surfaces of said first and said second rollers such that a continuous form disposed therebetween may be variably incremented according to selectable incrementing feed distances, and g. a clutch associated with said second switch and effective for translatably activating said second shaft in a second direction to thereby intermeshingly couple said second gear with said first gear and to frictionally couple said second roller with said first roller according to a selected phase relationship relative to the camming surfaces thereof.

6. The mechanism defined in claim 5 wherein the number of equally arced camming surfaces presented by the configuration of each of said first and second rollers is four.

7. The mechanism defined in claim 5 wherein said clutch is a tensionally loaded spring effective for translatably activating said second shaft in said second direction and for biasing said second shaft in such manner as to yieldably maintain an intermeshed coupling between said first and second gears and a frictional coupling between the camming surfaces of said first and second rollers.

8. The mechanism defined in claim 5 wherein said first switch is a knob that may be manually rotated to bring said first shaft to a said defined home position, and said second switch is a knob that may be axially manipulated to translate said second shaft in said first direction and rotatably activated to establish a selected one of said selectable phase relationships as between the camming surfaces of said first and second rollers.

9. In a continuous form feeding device of a printer or the like wherein web paper is feedably advanced between and by means of a pair of parallel driven shafts, improved incremental feed means associated with said pair of shafts and effective for variably incrementing the web paper advancement such that varying distances may be provided between the printed lines thereon, said improved incremental feed means comprising: translatable mounting means provided one of said pair of parallel shafts, a pair of gears fixed to said pair of shafts in intermeshed coupled relationship, at least one pair of rollers with radially interrupted peripheral camming surfaces fixed to said pair of shafts in frictionally coupled relationship, and manually operable clutching means associated with said shaft of translatable mounting and effective for yieldably maintaining the phase relationship as between the camming surfaces of each of said pair of rollers, said clutching means being manually manipulatable to translatably de-couple said intermeshed relationship between said pair of gears and said frictional relationship between the camming surfaces of said rollers and to rotatably establish a selected different phase relationship between said camming surfaces of said rollers whereby the distances between the printed lines on said web paper forms may be selectably varied.

* * * * *